US009740149B2

(12) United States Patent
Kobayashi

(10) Patent No.: US 9,740,149 B2
(45) Date of Patent: Aug. 22, 2017

(54) FIXING DEVICE HAVING ENDLESS BELT AND NIP MEMBER SLIDABLY CONTACTING INNER SURFACE OF ENDLESS BELT

(71) Applicant: Brother Kogyo Kabushiki Kaisha, Nagoya-shi, Aichi-ken (JP)

(72) Inventor: Akihiro Kobayashi, Yokkaichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/057,374

(22) Filed: Mar. 1, 2016

(65) Prior Publication Data

US 2016/0259281 A1 Sep. 8, 2016

(30) Foreign Application Priority Data

Mar. 6, 2015 (JP) ..... 2015-044256

(51) Int. Cl.
*G03G 15/20* (2006.01)

(52) U.S. Cl.
CPC . *G03G 15/2053* (2013.01); *G03G 2215/2035* (2013.01)

(58) Field of Classification Search
CPC ..... G03G 15/2053; G03G 15/2089; G03G 2215/2035
USPC ..... 399/329
See application file for complete search history.

(56) References Cited

U.S. PATENT DOCUMENTS

| | | | | |
|---|---|---|---|---|
| 6,787,737 | B2 | 9/2004 | Uekawa et al. | |
| 2003/0042241 | A1 | 3/2003 | Uekawa et al. | |
| 2003/0103788 | A1* | 6/2003 | Yura | G03G 15/2064 399/329 |
| 2011/0064443 | A1* | 3/2011 | Iwaya | G03G 15/2053 399/69 |
| 2012/0163886 | A1* | 6/2012 | Suzuki | G03G 15/2053 399/329 |
| 2013/0071157 | A1* | 3/2013 | Suzuki | G03G 15/2053 399/329 |
| 2014/0153983 | A1* | 6/2014 | Fujii | G03G 15/2053 399/329 |

FOREIGN PATENT DOCUMENTS

| | | | |
|---|---|---|---|
| JP | 2001-068261 | A | 3/2001 |
| JP | 2003-131502 | A | 5/2003 |
| JP | 2003-168542 | A | 6/2003 |
| JP | 2013-205445 | A | 10/2013 |
| JP | 2014-041246 | A | 3/2014 |

* cited by examiner

*Primary Examiner* — Sandra Brase
(74) *Attorney, Agent, or Firm* — Banner & Witcoff, Ltd.

(57) ABSTRACT

A fixing device includes an endless belt, a heat source, a nip member, and a backup member. The endless belt has an inner surface. The nip member has a contact surface slidably contacting the inner surface. The nip member is configured to be heated by the heat source. The backup member is configured to pinch the endless belt in cooperation with the nip member while the backup member rotates together with endless belt. The contact surface includes a first portion receiving urging force from the backup member and a second portion other than the first portion. At least a part of the first portion is coated by a first material providing a slidability higher than that of the nip member. The second portion includes a region uncoated with the first material.

24 Claims, 6 Drawing Sheets

FIXING DEVICE HAVING ENDLESS BELT AND NIP MEMBER SLIDABLY CONTACTING INNER SURFACE OF ENDLESS BELT

CROSS REFERENCE TO RELATED APPLICATION

This application claims priority from Japanese Patent Application No. 2015-044256 filed Mar. 6, 2015. The entire content of the priority application is incorporated herein by reference.

TECHNICAL FIELD

The present disclosure relates to a fixing device for thermally fixing a developer image formed onto a sheet.

BACKGROUND

There is known a fixing device including a metal sleeve having a cylindrical shape, a ceramic heater positioned at an internal space of the metal sleeve, and a pressure roller for nipping the metal sleeve in cooperation with the ceramic heater. The ceramic heater has a sliding surface in sliding contact with the metal sleeve, and an entire surface of the sliding surface is coated with an imide series resin such as polyimide so as to prevent an inner surface of the metal sleeve from wearing by the ceramic heater.

SUMMARY

According to the disclosed structure, heat conductivity from the ceramic heater to the metal sleeve is insufficient due to coating of the imide series resin over the entire sliding surface of the ceramic heater.

It is therefore an object of the present disclosure to provide a fixing device capable of improving heat conductivity from a nip member such as the ceramic heater to an endless belt such as the metal sleeve while enhancing slidability between the nip member and the endless belt.

In order to attain the above and other objects, the disclosure provides a fixing device includes an endless belt, a heat source, a nip member, and a backup member. The endless belt has an inner surface. The nip member has a contact surface slidably contacting the inner surface. The nip member is configured to be heated by the heat source. The backup member is configured to pinch the endless belt in cooperation with the nip member while the backup member rotates together with the endless belt. The contact surface includes a first portion receiving urging force from the backup member and a second portion other than the first portion. At least a part of the first portion is coated by a first material providing a slidability higher than that of the nip member. The second portion includes a region uncoated with the first material.

BRIEF DESCRIPTION OF THE DRAWINGS

The particular features and advantages of the disclosure as well as other objects will become apparent from the following description taken in connection with the accompanying drawings, in which.

DETAILED DESCRIPTION

A fixing device according to an embodiment will be described while referring to FIGS. 1 through 5. Directions in the following description will be based on an orientation of a color laser printer 1 shown in FIG. 1. Specifically, the left side of the printer 1 in FIG. 1 will be called the "front," the right side will be called the "rear," the near side will be called the "right," and the far side will be called the "left." Here, the terms "left" and "right" are defined when the color printer 1 is viewed from a front side.

Figure 1:
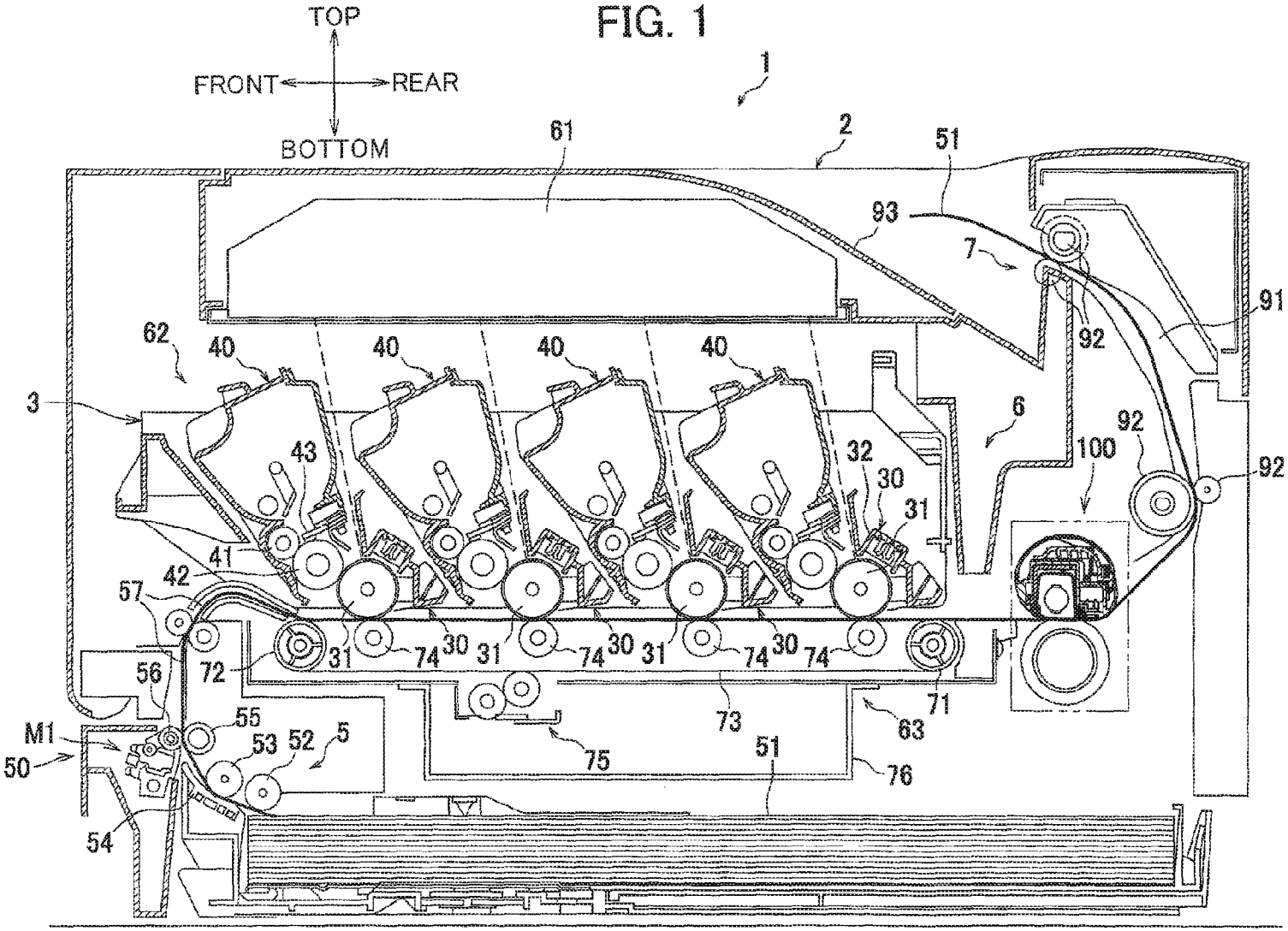
FIG. 1 is a cross-sectional view of a color printer provided with a fixing device according to an embodiment.

As shown in FIG. 1, the color printer 1 includes a main housing 2. Within the main housing 2, provided are a sheet supply unit 5 for supplying a sheet 51, an image forming unit 6 for forming an image on the sheet 51, and a discharge unit 7 for discharging a sheet 51 on which the image has been formed.

The sheet supply unit 5 is positioned in a lower portion of the main housing 2, and includes a sheet supply tray 50 and a sheet supplying mechanism M1. The sheet supply tray 50 is detachably attached to the main housing 2 by sliding operation from a front side of the housing 2. The sheet supplying mechanism M1 is configured to lift a leading end portion of the sheet 51 upward from the sheet supply tray 50, and then to turn the sheet 51 for conveying the sheet 51 rearward.

The sheet supplying mechanism M1 includes a pick-up roller 52, a separation roller 53, and a separation pad 54 that are positioned close to a front end portion of the sheet supply tray 50. An uppermost sheet 51 of sheets stacked on the sheet supply tray 50 is separated from the stacked sheet and is conveyed upward by these rollers 52, 53 and the pad 54. A paper dust removing roller 55 and a pinch roller 56 are provided downstream of the separation roller 53, and a conveyer passage 57 extends from the pinch roller 56 toward a conveyer belt 73 described later. The sheet 51 conveying upward is passed through a gap between the paper dust removing roller 55 and the pinch roller 56, so that paper dust deposited on the sheet 51 is removed therefrom. Then the sheet 51 is turned rearward along the conveyer passage 57 and is supplied to the conveyer belt 73.

The image forming unit 6 includes a scanner unit 61, a process unit 62, a transfer unit 63, and a fixing device 100.

The scanner unit 61 is provided in an upper portion of the main housing 2. Although not shown in the drawings, the scanner unit 61 includes a laser light-emitting unit, a polygon mirror, a plurality of lenses, and reflecting mirrors. The scanner unit 61 is configured to irradiate laser beams (indicated by broken lines in FIG. 1) corresponding to each color of cyan, magenta, yellow and black, from the laser light emitting unit in a high-speed scan in the left-right direction by the polygon mirror to expose the surfaces of corresponding photosensitive drums 31 to light that passed through the plurality of lenses and reflected by the reflection mirrors.

The process unit 62 is positioned below the scanner unit 61 and above the sheet supply unit 5, and includes a photosensitive unit 3 movable in frontward/rearward direction relative to the main housing 2. The photosensitive unit 3 includes four drum subunits 30 and four developing cartridges 40. Each of the developing cartridges 40 is detachably attached to the corresponding drum subunit 30.

The four drum subunits 30 and the four developing cartridges 40 are provided for four colors. The configurations of the four drum subunits 30 are the same and the configurations of the four developing cartridges 40 are the same. In the following descriptions, the explanation is made for one drum subunit 30 and one developing cartridge 40. The drum subunit 30 includes a photosensitive drum 31 and a scorotron charger 32. The developing cartridge 40 is configured to accommodate toner, and is provided with a supply roller 41, a developing roller 42 and a layer thickness regulation blade 43.

In the process unit 62, toner in the toner developing cartridge 40 is supplied to the developing roller 42 by the supply roller 41. In this instance, toner is triboelectrically charged between the supply roller 41 and the developing roller 42. Toner supplied to the developing roller 42 is scraped by the thickness regulation blade 43 in accordance with the rotation of the developing roller 42, so that a thin toner layer having a uniform thickness is carried on the developing roller 42.

On the other hand, in the drum subunit 30, the scorotron charger 32 performs corona discharge to apply a uniform charge to the surface of the photosensitive drum 31, after which the scanner unit 61 irradiates laser beams to expose surface of the corresponding photosensitive drum 31 to light for forming electrostatic latent image.

Then the toner carried on the surfaces of the developing roller 42 is then supplied to the electrostatic latent image formed on the corresponding photosensitive drum 31 upon rotation of the photosensitive drum 31 to produce visible toner image of the corresponding color on the photosensitive drum 31.

The transfer unit 63 includes a drive roller 71, a follower roller 72, the conveyer belt 73, transfer rollers 74, and a cleaning unit 75. The drive roller 71 and the follower roller 72 are spaced away from each other in the front-rear direction and extend in parallel to each other. The conveyer belt 73 is an endless belt 73 looped over these rollers 72, 73. The conveyer belt 73 has an outer surface in contact with each photosensitive drum 31. The transfer rollers 74 are arranged on an inside space of the loop formed by the conveyer belt 73 at positions for pinching the conveyer belt 73 against corresponding photosensitive drums 31. Transfer bias is applied to each transfer roller 74 from a high voltage board (not shown). A sheet 51 supplied by the conveyer belt 73 is conveyed and pinched between the photosensitive drums 31 and the transfer rollers 74, whereby the toner images formed on the photosensitive drums 31 are respectively transferred to and superposed on the sheet 51.

The cleaning unit 75 is positioned below the conveyer belt 73 for removing toner adhered to the conveyer belt 73. A toner retainer 76 is positioned below the cleaning unit 75. Toner removed by the cleaning unit 75 is dropped in the toner retainer 76.

The fixing device 100 is disposed rearward of the transfer unit 63 for thermally fixing, to the sheet 51, a toner image that has been transferred onto the sheet 51. Details of the fixing device 100 will be described later.

In the discharge unit 7, a discharge side sheet conveyer passage 91 extends upward from an exit of the fixing device 100 and is then turned frontward. A plurality of sheet conveyer rollers 92 are provided along the conveyer passage 91. A discharge tray 93 is formed at an upper surface of the main housing 2. The sheet 51 conveyed by the conveyer rollers 92 is discharged onto the discharge tray 93.

Figure 2:
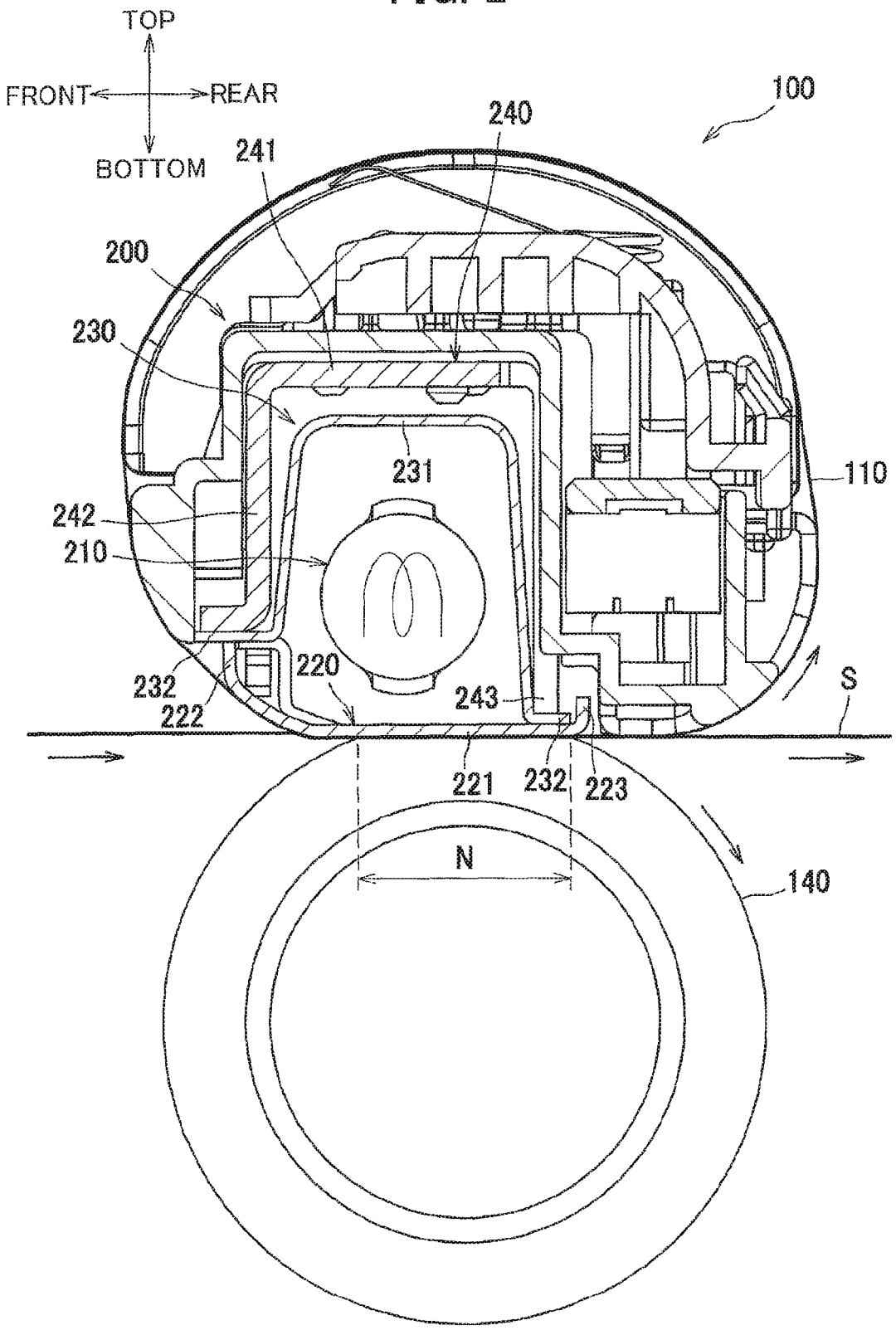
FIG. 2 is a cross-sectional view illustrating the fixing device according to the embodiment.

As shown in FIG. 2, the fixing device 100 includes a fixing belt 110 as an example of an endless belt, a heat unit 200 provided in an internal space of the fixing belt 110 for heating the fixing belt 110, and a pressure roller 140 as an example of a backup member for nipping the fixing belt 110 in cooperation with the heat unit 200.

The fixing belt 110 is a tubular member or an endless belt providing heat resistivity and flexibility. The fixing belt 110 is made from polyimide. The fixing belt 110 is circularly movable and its movement is guided by a guide member (not shown).

The pressure roller 140 is disposed below the fixing belt 110 and the heat unit 200 and is resiliently deformable. Upon resilient deformation of the pressure roller 140, the pressure roller 140 nips the fixing belt 110 in cooperation with the heat unit 200 (nip plate 220 described later), thereby forming a nip region N with respect to the fixing belt 110. The pressure roller 140 and the heat unit 200 are urged toward each other to provide a pressure contact therebetween.

A motor (not shown) is provided in the main housing 2 for rotationally driving the pressure roller 140. Rotation of the pressure roller 140 causes circular movement of the fixing belt 110 through frictional force with the surface of fixing belt 110 or via the sheet 51. Thus, the toner image carried on the sheet 51 is thermally fixed to the sheet 51 when the sheet 51 is conveyed the front-to-rear direction between the pressure roller 140 and the heated fixing belt 110.

The heat unit 200 is configured to heat toner carried on the sheet 51 through the fixing belt 110. The heat unit 200 includes a halogen lamp 210 as an example of a heat source, a nip plate 220 as an example of a nip member, a reflection member 230, and a stay 240.

The halogen lamp 210 is a typical example of the heater and is adapted to generate heat, i.e., radiant heat upon electrical power supply for heating the nip plate 220 and the fixing belt 110. The halogen lamp 210 is disposed in the internal space of the fixing belt 110 and is spaced apart at a prescribed distance from an inner surface of the nip plate 220. The halogen lamp 210 is also spaced apart at a prescribed distance from the inner surface of the fixing belt 110.

The nip plate 220 is a plate-like member and is configured to receive radiant heat from the halogen lamp 210. The nip plate 220 is disposed in the internal space of the fixing belt 110, and has a lower surface in relative sliding contact with an inner circumferential surface of the fixing belt 110. The nip plate 220 is provided by processing a metal plate such as aluminum plate whose thermal conductivity is higher than that of the stay 240 made from steel. Details of the nip plate 220 will be described later.

The reflection plate 230 is configured to reflect radiant heat from the halogen lamp 210 toward the nip plate 220. The reflection plate 230 is disposed to cover the halogen lamp 210 and is spaced away from the halogen lamp 210 by a prescribed distance.

By the reflection plate 230, radiant heat from the halogen lamp 210 can be concentrated on the nip plate 220, so that the radiant heat from the halogen lamp 210 can be efficiently utilized. Thus, the nip plate 220 and the fixing belt 110 can be heated promptly.

More specifically, the reflection plate 230 is generally U-shaped and is made from a material providing high reflection ratio for the reflection of infrared ray and far infrared ray. The reflection plate 230 has thermal conductivity higher than that of the stay 240. For example, aluminum plate bended in a U-shape is used as the reflection plate 230. More specifically, the reflection plate 230 includes a reflecting portion 231 having a general U-shape in cross-section along a plane orthogonal to the left-right direction, and flange portions 232 extending outward in a front-rear direction (in a direction away from the halogen lamp 210) from respective ends of the reflecting portion 231. The reflection member 230 has a thickness smaller than that of the stay 240.

The stay 240 is positioned opposite to the pressure roller 140 with respect to the nip plate 220. The stay 240 is adapted to receive force applied from front and rear end portions of the nip plate 220 when force is applied from the pressure roller 140 to the nip plate 220. The stay 240 is made from a metal plate having high rigidity such as a steel plate. The stay 240 is bent to have a generally U-shape whose open end opposes the nip pate 220, and the U-shape being along the shape of the reflection plate 230.

More specifically, the stay 240 includes an upper wall 241 positioned above the halogen lamp 210, a front wall 242 extending downward from a front end of the upper wall 241, and a rear wall 243 extending downward from a rear end of the upper wall 241.

The front wall 242 is positioned upstream of the halogen lamp 210 in the sheet conveying direction. The front wall 242 has a lower end portion nipping the front flange portion 232 of the reflection plate 230 in cooperation with the nip plate 220. The lower end portion of the front wall 242 supports a front end portion of the nip plate 220 from above.

The rear wall 243 is positioned downstream of the halogen lamp 210 in the sheet conveying direction. The rear wall 243 has a lower end portion nipping the rear flange portion 232 of the reflection plate 230 in cooperation with the nip plate 220. The lower end portion of the rear wall 243 supports a rear end portion of the nip plate 220 from above.

Figure 3:
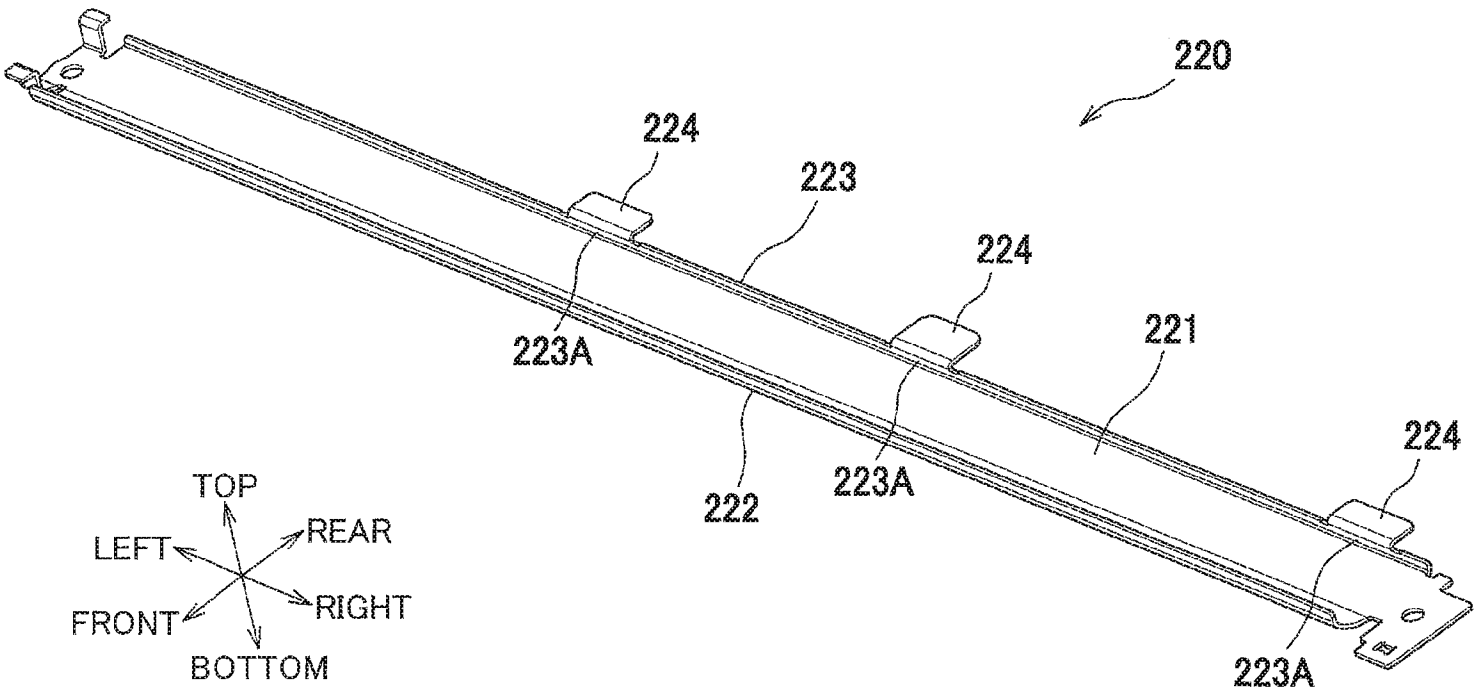
FIG. 3 is a perspective view of a nip plate in the fixing device according to the embodiment.

As shown in FIG. 3, the nip plate 220 has a base portion 221 elongated in the left-right direction, a front wall portion 222 protruding upward from a front end of the base portion 221, a rear wall portion 223 protruding upward from a rear end of the base portion 221, and three detected portions 224 protruding rearward from an upper end of the rear wall portion 223. The detected portions 224 are portions at which a temperature is detected by temperature sensors (not shown) for detecting a temperature of the nip plate 220. A contact type or non-contact type thermostat is available as the temperature sensors.

Figure 4:
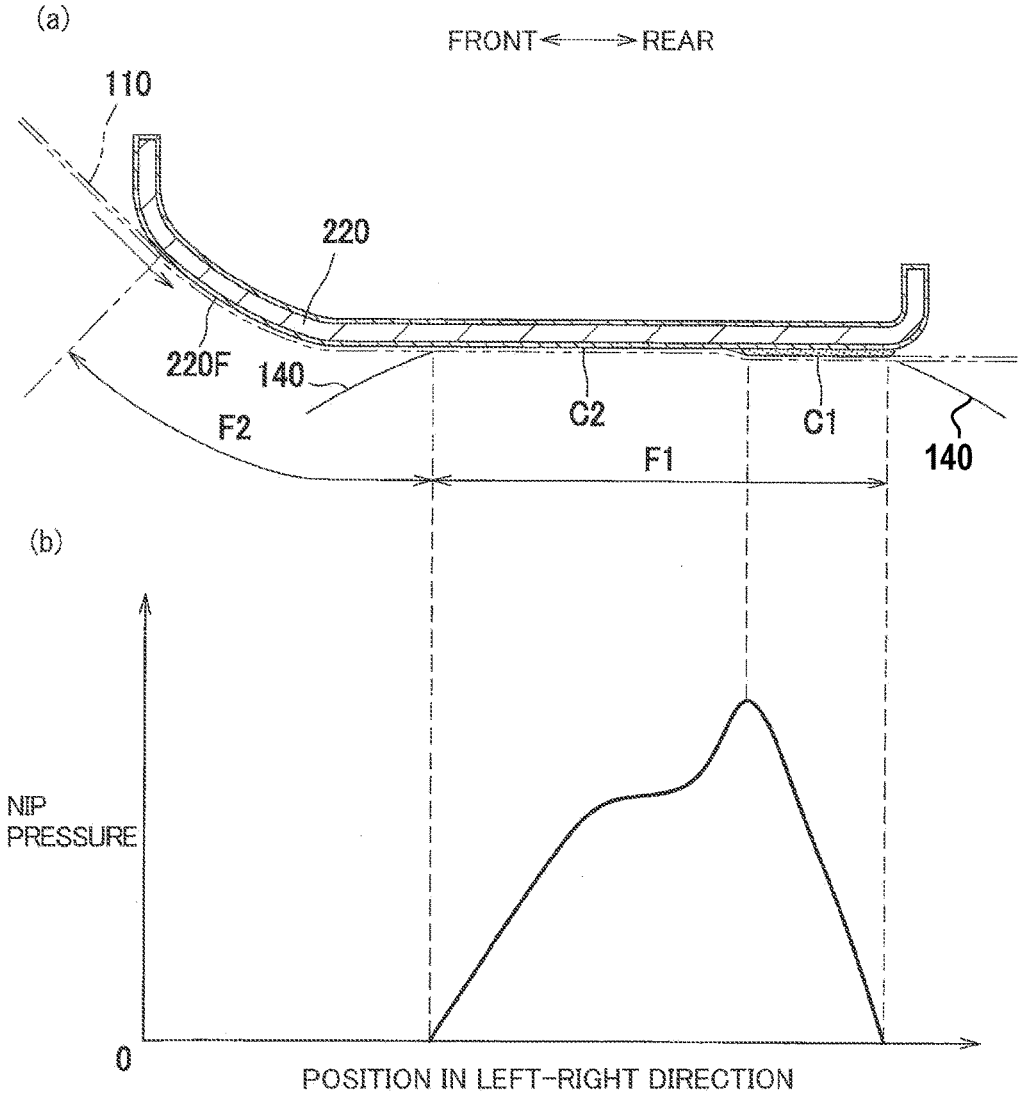
FIG. 4 is an explanation diagram illustrating the nip plate, wherein a part (a) is an enlarged cross-sectional view of the nip plate and a component ambient thereto in the fixing device according to the embodiment, and a part (b) is a graphical representation showing a relationship between nip pressure and a position in of the nip plate the front-rear direction.

As shown in a part (a) of FIG. 4, the entire surface of the nip plate 220 having the structure described above is coated with a nickel-phosphorus layer C2 as an example of a second material, and the bottom surface of the layer C2 on the rear portion of the nip plate 220 is coated with a polyimide layer C1 as an example of a first material. The nickel-phosphorus layer C2 has better sliding characteristics (or higher slidability) than the nip plate 220 formed of aluminum. That is, the nickel phosphorus layer C2 generates less friction force against the polyimide fixing belt 110 than the nip plate 220. Through a plating process, the nickel phosphorus layer C2 is formed over the entire surface of the nip plate 220 at a substantially uniform thickness.

The polyimide layer C1 has better sliding characteristics (or higher slidablity) than the nickel-phosphorus layer C2. That is, the polyimide layer C1 generates less friction force against the polyimide fixing belt 110 than the nickel-phosphorus layer C2. The layer C1 is formed by coating the lower surface of the nip plate 220 in the rear end portion thereof at a substantially uniform thickness after the layer C2 has been applied. For convenience in the following description, the layer C1 will be called the coating layer C1, and the layer C2 will be called the plating layer C2.

Since the plating layer C2 is formed over the entire surface of the nip plate 220, an entire contact surface 220F of the nip plate 220 that contacts the fixing belt 110 is coated with the plating layer C2. Here, the contact surface 220F of the nip plate 220 denotes the surface of the nip plate 220 that contacts the fixing belt 110 if the coating layer C1 and the plating layer C2 are not provided. Put another way, the contact surface 220F is the surface of the nip plate 220 contacting the fixing belt 110 through the coating layer C1 and the plating layer C2. In other words, the layers C1 and C2 are sandwiched between the contact surface 220F and the fixing belt 110.

The contact surface 220F has a first region F1 that receives pressure from the pressure roller 140, and a second region F2 constituting the remainder of the contact surface 220F excluding the first region F1. In other words, the second region F2 is the portion of the contact surface 220F that does not receive pressure from the pressure roller 140. Only part of the first region F1 is coated with the coating layer C1, while none of the second region F2 is coated with the coating layer Cl.

Figure 5:
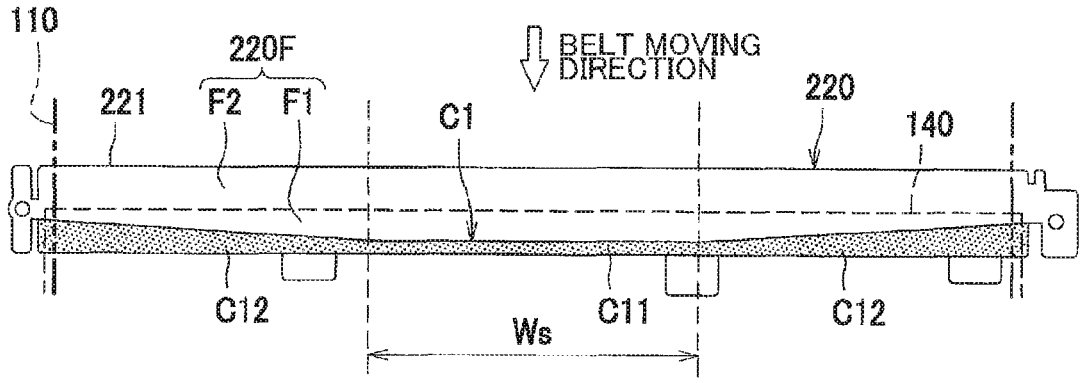
FIG. 5 is a bottom view of the nip plate.

The contact surface 220F also denotes the portion on the bottom surface of the nip plate 220 that is contacted by the fixing belt 110, and specifically the region inside of the two two-dot chain lines shown in FIG. 5. That is, the region within the two-dot chain lines shown in FIG. 5 indicates the region of the fixing belt 110. Note that the fixing belt 110 moves slightly left and right while circulating and, hence, the contact surface 220F actually includes areas outside the two two-dot chain lines in the left-right direction. However, the following description will treat the contact surface 220F as the region within the two two-dot chain lines for convenience.

The first region F1 constitutes the portion of the contact surface 220F that is pressed by the pressure roller 140, i.e., the portion of the contact surface 220F inside the two two-dot chain lines and downstream of the dashed line in FIG. 5 in the circulating direction of the fixing belt 110 (or a belt moving direction at a region where the fixing belt 110 contacts to the contact surface 220F). Here, the region indicated by the dashed line denotes a region of the pressure roller 140 where the fixing belt 110 contacts the pressure roller 140. The second region F2 constitutes the portion of the contact surface 220F that is not pressed by the pressure roller 140, i.e., the portion inside the two two-dot chain lines and upstream of the dashed line with respect to the circulating direction of the fixing belt 110.

Only the downstream portion of the first region F1 with respect to the circulating direction has been coated with the coating layer C1. That is, the upstream portion of the first region F1 located upstream of the downstream portion is not coated with the coating layer C1. More specifically, the coating layer C1 has an inner portion C11 occupying a left-right center region equivalent in width to a width Ws of smallest-width sheets 51, and two outer portions C 12 positioned outside the inner portion C11. Here, the smallest-width sheets 51 has the smallest width Ws among sheets 51 that can be fixed in or can be conveyed by the fixing device 100. The inner portion C11 is positioned downstream of a center of the first region F1 in the belt moving direction.

The area of the outer portions C12 in a cross section taken along a plane orthogonal to the left-right direction is greater than the area of the inner portion C11 in a cross section taken along a plane orthogonal to the left-right direction. In other words, a length of each outer portion C12 in the circulating direction (or, the front-to-rear direction) is greater than a length of the inner portion C11 in the circulating direction (or, the front-to-rear direction). Here, the left-right direction is both an example of a width direction of the sheet 51 and an example of the axial direction of the pressure roller 140.

More specifically, the outer portions C12 are formed to gradually expand upstream in the circulating direction of the fixing belt 110 while progressing outward from the inner portion C11 in the left-right direction. The outer portions C12 extend from the inner portion C11 to positions outside of the first region Fl in the left-right direction. Specifically, each of the outer portions C12 extends to the corresponding one of the outer left edge and the outer right edge of the base portion 221 constituting the nip plate 220.

The fixing device 100 of the embodiment described above obtains the following effects. Since part of the first region F1, which is the portion of the contact surface 220F on the nip plate 220 that receives pressure from the pressure roller 140, is coated with the coating layer C1 having good sliding characteristics, sliding characteristics of the nip plate 220 against the fixing belt 110 can be improved. Further, since the second region F2 is not coated with the coating layer C1, the fixing device 100 can achieve better heat conductivity from the nip plate 220 to the fixing belt 110 than a conceivable construction in which the entire second region is coated with a coating layer, for example.

Since the contact surface 220F is coated with the plating layer C2 having good sliding characteristics, sliding characteristics of the nip plate 220 against the fixing belt 110 can be improved.

By providing the coating layer C1 only on the downstream portion of the first region F1 with respect to the rotating direction of the pressure roller 140, as shown in a part (a) of FIG. 4, a step in the area of the coating layer C1 is formed on the first region F1, that is, a difference in level is formed at a border of the layer C1 and the layer C2. This step is the portion of the contact surface 220F that receives pressure from the pressure roller 140. Consequently, the nip pressure in the area of the coating layer C1 near the border is higher than in other regions of the first region F1, as indicated by the graph in a part (b) of FIG. 4. Thus, the toner image on the sheet 51 can be preheated in the upstream part of the first region F1 where the coating layer C1 is not provided, and subsequently can be suitably fixed to the sheet 51 in the downstream part of the first region F1 where the pressure is greater.

Since the cross-sectional area of the outer portions C12 is greater than that of the inner portion C11, a greater amount of coating layer Cl per unit length in the left-right direction is provided in the outer portions C12 than in the inner portion C11. This arrangement can prevent the temperature in regions of the nip plate 220 outside the center region having the smallest width Ws of the smallest sheet 51 from becoming excessively high during fixing operations on the smallest sheets 51. Rising temperature in the edges of the nip plate 220 is particularly problematic when the fixing belt 110 is formed of polyimide, as in the embodiment, because the fixing belt 110 formed of polyimide can incur damage from high heat transmitted from the edges of the nip plate 220 to the edges of the fixing belt 110.

While the disclosure has been described in detail with reference to the above embodiments thereof, it would be apparent to those skilled in the art that various changes and modifications may be made therein. In the following description, like parts and components are designated with the same reference numerals to avoid duplicating description.

The coating layer C1 may be formed in various shapes and is not limited to the shape described in the embodiment. For example, the coating layer C1 may have the shape shown in a part (a) of FIG. 6.

Figure 6:
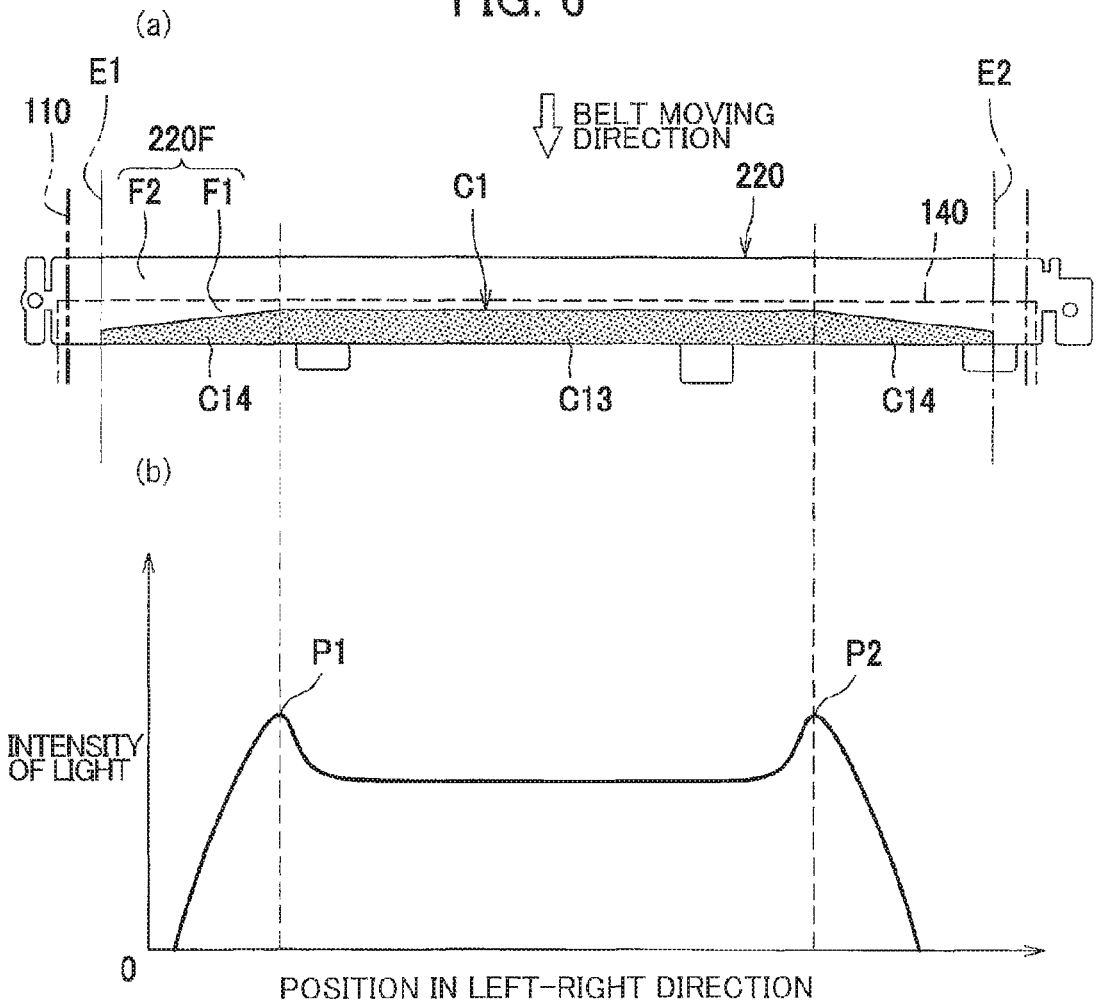
FIG. 6 is an explanation diagram illustrating a nip plate according to a first modification where a part (a) is a bottom view of the nip plate with a coating layer, and a part (b) is a graphical representation showing a relationship between light quantity and a position of the coating layer in the left-right direction according to the first modification.

As shown in a part (b) of FIG. 6, the halogen lamp 210 used in the variation of the part (a) of FIG. 6 has a light distribution in the left-right direction that peaks in two locations P1 and P2. More specifically, the light distribution of the halogen lamp 210 shows a gradual decrease in intensity to zero from the peaks P1 and P2 toward the outer left-right ends, a substantially uniform intensity in the left-right center region, and a gradual decrease in light intensity inward in the left-right direction from the peaks P1 and P2 toward the center region having the substantially uniform light intensity.

The coating layer C1 has an inner portion C13 located between the two positions corresponding to the peaks P1 and P2 with respect to the left-right direction, and two outer portions C14 located outside the inner portion C13. The area of a cross section of the outer portions C 14 taken along a plane orthogonal to the left-right direction is smaller than the area of a cross section of the inner portion C13 taken along a plane orthogonal to the left-right direction. In other words, a length of the outer portions C14 in the circulating direction (or, the front-to-rear direction) is smaller than a length of the inner portion C13 in the circulating direction (or, the front-to-rear direction).

More specifically, the outer portions C14 are shaped to gradually narrow toward the downstream side in the circulating direction of the fixing belt 110 while progressing outward from the inner portion C13 in the left-right direction. The outer portions C14 extend outward in the left-right direction from the inner portion C13 to positions corresponding to the left-right edges E1 and E2 of the widest sheet 51 that can be fixed in the fixing device 100. Here, since the widest sheet may move slightly left and right while being conveyed, the positions corresponding to the left-right edges E1 and E2 are set with consideration for such left-right movement. For example, a length between E1 and E2 may be slightly larger than the actual width of the widest sheet.

The lengths of the outer portions C14 in the front-rear direction (the circulating direction of the fixing belt 110) at the positions corresponding to the left-right edges E1 and E2 may be a prescribed length such as that shown in the drawings, or may be zero.

The variation of the embodiment described above can obtain the following effects. Normally, the temperature of the nip plate 220 does not tend to rise as much in the regions outside the peaks P1 and P2 of the light distribution than in the center region between the peaks P1 and P2. Since this variation sets the cross-sectional area of the outer portions C14 smaller than that of the inner portion C13, the outer portions C14 have a smaller amount of the coating layer C1 per unit length in the left-right direction than the inner portion C13. Hence, the variation described above can better circumvent the tendency of temperature not to rise in areas of the nip plate 220 outside the peaks P1 and P2 than a nip plate whose coating layer is configured to have the same cross-sectional area in the inner portion and outer portions, for example.

This variation is particularly suitable when the fixing belt 110 is formed of stainless steel because a stainless steel fixing belt 110 is unlikely to incur heat damage, even when the temperature of the nip plate 220 becomes excessively hot on the side ends, as described above.

Figure 7:
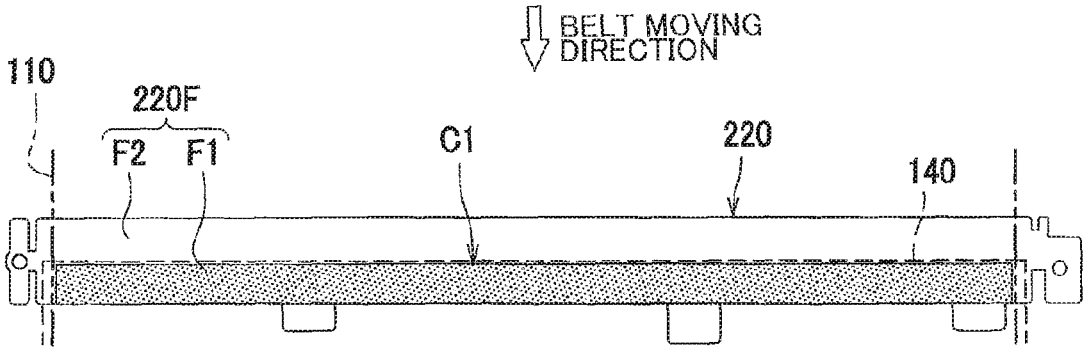
FIG. 7 is a bottom view of a nip plate with a coating layer according to a second modification.

In the embodiment described above, the coating layer C1 is provided only on part of the first region F1, but the coating layer C1 may be applied over the entire first region F1, as illustrated in FIG. 7, for example. Coating the entire first region F1 with a coating layer C1 having good sliding characteristics can further improve the ability of the fixing belt 110 to slide against the nip plate 220.

In the embodiment described above, the entire second region F2 is not coated with the coating layer C1, but the second region may be coated with a coating layer in very small areas, provided that the second region also has uncoated areas.

While polyimide is used as an example of the first material in the embodiment described above, the first material of the present disclosure may be a fluororesin or polyetheretherketone. Similarly, the second material is not limited to nickel-phosphorus, but may be a chromium or diamond-like carbon (DLC) coating, for example.

In the embodiment described above, the outer portions C12 and C14 are formed with a different cross-sectional area than the inner portions C11 and C13 by varying their dimensions in the circulating direction of the fixing belt 110, but the cross-sectional areas of the outer portions may be varied from that of the inner portion by modifying their thicknesses. For example, a thickness of each outer portion C12 in the circulating direction (or, the front-to-rear direction) may be thicker than a thickness of the inner portion C11 in the circulating direction (or, the front-to-rear direction. In this case, the lengths of the outer portion C11 and the inner portion C11 in the belt moving direction may be the same. A thickness of each outer portion C14 in the circulating direction (or, the front-to-rear direction) may be thinner than a thickness of the inner portion C13 in the circulating direction (or, the front-to-rear direction. In this case, the lengths of the outer portion C14 and the inner portion C13 in the belt moving direction may be the same.

Further, in the above-described embodiment, the halogen lamp 210 is used as the heat source. However, a carbon heater is also available as the heat source. Further, in the above-described embodiment, the nip plate 220 is used as the nip member. However, as the nip member, a ceramic heater is available in which a heat source is incorporated therein.

Further, in the above-described embodiment, the pressure roller 140 is used as the backup member. However, a belt like pressure member is also available as the backup member.

Further, in the above-described embodiment, a plain paper (such as a thick sheet, a postcard, and a thin sheet) is used as the sheet 51. However, sheet other than plain paper such as OHP sheets are also available.

Further, as the image forming apparatus, the color laser printer 1 is exemplified. However, a copying machine, a facsimile machine and a multifunction peripheral are also available.

What is claimed is:

1. A fixing device comprising:

an endless belt having an inner surface;

a heat source;

a nip member having a contact surface slidably contacting the inner surface, the nip member being configured to be heated by the heat source; and a backup member configured to pinch the endless belt in cooperation with the nip member while the backup member rotates together with the endless belt, wherein the contact surface includes a first portion receiving urging force from the backup member and a second portion other than the first portion, at least a part of the first portion being coated by a first material providing a slidability higher than that of the nip member, and the second portion including a region uncoated with the first material, wherein the contact surface is coated with a second material providing a slidability higher than that of the nip member and lower than that of the first material, and wherein the first material is coated over the second material.

2. The fixing device according to claim 1, wherein the endless belt is configured to be moved in a moving direction at a position where the inner surface contacts the contact surface;

wherein the first portion includes an upstream portion and a downstream portion located downstream of the upstream portion in the moving direction, only the downstream portion being coated by the first material.

3. The fixing device according to claim 1, wherein the endless belt is configured to be moved in a moving direction at a position where the inner surface contacts the contact surface;

wherein the endless belt and the backup member are capable of conveying a sheet in the moving direction, provided that a width of the conveyed sheet in a widthwise direction orthogonal to the moving direction is larger than a minimum width;

wherein the endless belt has a contacting region configured to contact a conveyed sheet having the minimum width;

wherein the contact surface has a partial region corresponding to the contact region;

wherein the first material located inside of the partial region in the widthwise direction provides a first cross-sectional area taken along a plane orthogonal to the widthwise direction; and wherein the first material located outside of the partial region in the widthwise direction provides a second cross-sectional area taken along a plane orthogonal to the widthwise direction, the second cross-sectional area being larger than the first cross-sectional area.

4. The fixing device according to claim 1, wherein the backup member is configured to be rotated about a rotational axis extending in an axial direction;

wherein the heat source is configured to emit light whose distribution in the axial direction has two peaks;

wherein the contact surface has a partial region between the two peaks in the axial direction, wherein the first material located inside of the partial region provides a first cross-sectional area taken along a plane orthogonal to the axial direction;

wherein the first material located outside of the partial region provides a second cross-sectional area taken along a plane orthogonal to the axial direction, the second cross-sectional area being smaller than the first cross-sectional area.

5. The fixing device according to claim 1, wherein the first material is coated on an entire region of the first portion.

6. The fixing device according to claim 1, wherein the second material is nickel phosphorus.

7. The fixing device according to claim 1, wherein the first material is made from a material selected from the group consisting of polyimide, fluororesin, and polyetheretherketone.

8. The fixing device according to claim 1, wherein the endless belt is configured to be moved in a moving direction at a position where the inner surface contacts the contact surface, wherein the first portion includes one end and another end in a widthwise direction orthogonal to the moving direction, the first material being provided from the one end to the another end.

9. The fixing device according to claim 1, wherein the endless belt is configured to be moved in a moving direction at a position where the inner surface contacts the contact surface;

wherein the endless belt and the backup member are capable of conveying a sheet in the moving direction, provided that a width of the conveyed sheet in a widthwise direction orthogonal to the moving direction is smaller than a maximum width;

wherein the endless belt has a contacting region configured to contact a conveyed sheet having the maximum width;

wherein the contact surface has a partial region corresponding to the contact region, the contact region having one end and another end in the widthwise direction, the first material being provided from the one end to the another end.

10. A fixing device comprising:

an endless belt having an inner surface;

a heat source;

a nip member having a contact surface slidably contacting the inner surface, the nip member being configured to be heated by the heat source; and a backup member configured to pinch the endless belt in cooperation with the nip member while the backup member rotates together with the endless belt, wherein the contact surface includes a first portion receiving urging force from the backup member and a second portion other than the first portion, at least a part of the first portion being coated by a first material providing a slidability higher than that of the nip member, and the second portion including a region uncoated with the first material, wherein the endless belt is configured to be moved in a moving direction at a position where the inner surface contacts the contact surface, and wherein the first portion includes an upstream portion and a downstream portion located downstream of the upstream portion in the moving direction, only the downstream portion being coated by the first material.

11. The fixing device according to claim 10, wherein the endless belt and the backup member are capable of conveying a sheet in the moving direction, provided that a width of the conveyed sheet in a widthwise direction orthogonal to the moving direction is larger than a minimum width;

wherein the endless belt has a contacting region configured to contact a conveyed sheet having the minimum width;

wherein the contact surface has a partial region corresponding to the contact region;

wherein the first material located inside of the partial region in the widthwise direction provides a first cross-sectional area taken along a plane orthogonal to the widthwise direction;

wherein the first material located outside of the partial region in the widthwise direction provides a second cross-sectional area taken along a plane orthogonal to the widthwise direction, the second cross-sectional area being larger than the first cross-sectional area.

12. The fixing device according to claim 10, wherein the backup member is configured to be rotated about a rotational axis extending in an axial direction;

wherein the heat source is configured to emit light whose distribution in the axial direction has two peaks;

wherein the contact surface has a partial region between the two peaks in the axial direction, wherein the first material located inside of the partial region provides a first cross-sectional area taken along a plane orthogonal to the axial direction;

wherein the first material located outside of the partial region provides a second cross-sectional area taken along a plane orthogonal to the axial direction, the second cross-sectional area being smaller than the first cross-sectional area.

13. The fixing device according to claim 10, wherein the first material is coated on an entire region of the first portion.

14. The fixing device according to claim 10, wherein the first material is made from a material selected from the group consisting of polyimide, fluororesin, and polyetheretherketone.

15. The fixing device according to claim 10, wherein the first portion includes one end and another end in a widthwise direction orthogonal to the moving direction, the first material being provided from the one end to the another end.

16. The fixing device according to claim 10, wherein the endless belt and the backup member are capable of conveying a sheet in the moving direction, provided that a width of the conveyed sheet in a widthwise direction orthogonal to the moving direction is smaller than a maximum width, wherein the endless belt has a contacting region configured to contact a conveyed sheet having the maximum width, and wherein the contact surface has a partial region corresponding to the contact region, the contact region having one end and another end in the widthwise direction, the first material being provided from the one end to the another end.

17. A fixing device comprising:

an endless belt having an inner surface;

a heat source;

a nip member having a contact surface slidably contacting the inner surface, the nip member being configured to be heated by the heat source; and a backup member configured to pinch the endless belt in cooperation with the nip member while the backup member rotates together with the endless belt, wherein the contact surface includes a first portion receiving urging force from the backup member and a second portion other than the first portion, at least a part of the first portion being coated by a first material providing a slidability higher than that of the nip member, and the second portion including a region uncoated with the first material, wherein the endless belt is configured to be moved in a moving direction at a position where the inner surface contacts the contact surface, wherein the endless belt and the backup member are capable of conveying a sheet in the moving direction, provided that a width of the conveyed sheet in a widthwise direction orthogonal to the moving direction is larger than a minimum width, wherein the endless belt has a contacting region configured to contact a conveyed sheet having the minimum width, wherein the contact surface has a partial region corresponding to the contact region, wherein the first material located inside of the partial region in the widthwise direction provides a first cross-sectional area taken along a plane orthogonal to the widthwise direction, and wherein the first material located outside of the partial region in the widthwise direction provides a second cross-sectional area taken along a plane orthogonal to the widthwise direction, the second cross-sectional area being larger than the first cross-sectional area.

18. The fixing device according to claim 17, wherein the first material located inside of the partial region in the widthwise direction provides a first length in the moving direction, and wherein the first material located outside of the partial region in the widthwise direction provides a second length in the moving direction, the second length being larger than the first length.

19. The fixing device according to claim 17, wherein the first material located inside of the partial region in the widthwise direction provides a first thickness, wherein the first material located outside of the partial region in the widthwise direction provides a second thickness thicker than the first thickness.

20. The fixing device according to claim 17, wherein the first material located outside of the partial region gradually and outwardly expands upstream in the moving direction.

21. A fixing device comprising:

an endless belt having an inner surface;

a heat source;

a nip member having a contact surface slidably contacting the inner surface, the nip member being configured to be heated by the heat source; and a backup member configured to pinch the endless belt in cooperation with the nip member while the backup member rotates together with the endless belt, wherein the contact surface includes a first portion receiving urging force from the backup member and a second portion other than the first portion, at least a part of the first portion being coated by a first material providing a slidability higher than that of the nip member, and the second portion including a region uncoated with the first material, wherein the backup member is configured to be rotated about a rotational axis extending in an axial direction, wherein the heat source is configured to emit light whose distribution in the axial direction has two peaks, wherein the contact surface has a partial region between the two peaks in the axial direction, wherein the first material located inside of the partial region provides a first cross-sectional area taken along a plane orthogonal to the axial direction, and wherein the first material located outside of the partial region provides a second cross-sectional area taken along a plane orthogonal to the axial direction, the second cross-sectional area being smaller than the first cross-sectional area.

22. The fixing device according to claim 21, wherein the endless belt is configured to be moved in a moving direction, wherein the first material located inside of the partial region in a widthwise direction, orthogonal to the moving direction, provides a first length in the moving direction, and wherein the first material located outside of the partial region in the widthwise direction provides a second length in the moving direction, the second length being smaller than the first length.

23. The fixing device according to claim 21, wherein the endless belt is configured to be moved in a moving direction, wherein the first material located inside of the partial region in a widthwise direction, orthogonal to the moving direction, provides a first thickness, and wherein the first material located outside of the partial region in the widthwise direction provides a second thickness thinner than the first thickness.

24. The fixing device according to claim 21, wherein the endless belt is configured to be moved in a moving direction at a position where the inner surface contacts the contact surface, and wherein the first material located outside of the partial region gradually and outwardly becomes narrow toward downstream side in the moving direction from the inside end to the outside end.

* * * * *